United States Patent [19]

Gauntlett

[11] 3,935,975

[45] Feb. 3, 1976

[54] CONTAINERS

[76] Inventor: John Harry Gauntlett, Mayfield 7 Kingsdene, Tadworth, United Kingdom

[22] Filed: July 26, 1973

[21] Appl. No.: 382,735

Related U.S. Application Data

[63] Continuation of Ser. No. 107,286, Jan. 18, 1971, abandoned.

[30] Foreign Application Priority Data

| | | |
|---|---|---|
| Jan. 9, 1970 | United Kingdom | 2403/70 |
| May 13, 1970 | United Kingdom | 23041/70 |
| June 11, 1970 | United Kingdom | 28330/70 |

[52] U.S. Cl. ..... 222/490; 222/511

[51] Int. Cl.[2] ..... B65D 37/00

[58] Field of Search ..... 222/213, 212, 215, 490, 222/512, 517, 556, 566, 572, 494, 511; 220/4 B; 229/62.5; 150/9; 251/144, 342

[56] References Cited

UNITED STATES PATENTS

| | | | |
|---|---|---|---|
| 2,316,516 | 4/1943 | Hammerstein | 222/490 |
| 3,610,477 | 10/1971 | Herzig | 222/213 |
| 3,646,856 | 9/1972 | Worndl | 229/62.5 X |
| 3,647,386 | 3/1972 | Gilford | 229/62.5 X |

FOREIGN PATENTS OR APPLICATIONS

| | | | |
|---|---|---|---|
| 446,248 | 1/1935 | United Kingdom | 222/179.5 |

*Primary Examiner*—Robert B. Reeves
*Assistant Examiner*—John P. Shannon
*Attorney, Agent, or Firm*—Watson, Cole, Grindle & Watson

[57] ABSTRACT

This invention is a seal for a moulded plastics container for pressurised fluid, consisting of a resilient flap normally held closing an opening in the container wall by its resilience and by pressure differential. The container can be made by a compression moulding process in which the moulds are progressively closed after the material is injected.

10 Claims, 27 Drawing Figures

INVENTOR
JOHN H. GAUNTLETT

BY
Watson, Cole, Grindle + Watson,
ATTORNEYS

INVENTOR
JOHN H. GAUNTLETT

BY
Watson, Cole, Grindle + Watson
ATTORNEYS

INVENTOR
JOHN H. GAUNTLETT

BY
watson, Cole, Grindle & Watson
ATTORNEYS

INVENTOR
JOHN H. GAUNTLETT

BY

Watson, Cole, Grindle & Watson
ATTORNEYS

INVENTOR
JOHN H. GAUNTLETT

BY
Watson, Cole, Grindle & Watson
ATTORNEYS

INVENTOR
JOHN H. GAUNTLETT

BY
Watson, Cole, Grindle & Watson
ATTORNEYS

CONTAINERS

This is a continuation of co-pending application Ser. No. 107,286, filed Jan. 18, 1971, now abandoned.

This invention relates to a closure for a sealed fluid container, for example for a carbonated drink, or a fluid to be stored, or for a paste or cream to be dispensed as from a tube.

According to the invention the closure comprises an opening in the container wall and a resilient flap member having a surface normally acting by its resilience to close the opening.

Once closed, the flap will be held sealing the opening by the pressure difference across it, whether the inside of the container is above or below atmospheric pressure. When the face of the flap covers, and is sealed to, a face surrounding the opening, there will also be an area differential assisting in retaining the seal.

The seal must be broken to open the opening and this could be by mechanically distorting the flap or the container wall around the flap is this wall is resilient. However when the opening is to be closed again, the resilience of the flap material will give a priming or initiating action which will be assisted by the pressure differential.

One illustration of the theory of the invention is shown in FIG. 16. The container wall is shown at 1 for a high internal pressure container and 2 for a low internal pressure container. The opening 3 to be sealed is in a wall 4, and this wall is united with two opposed flaps 5, 6 of resilient material joined at the edges to form a tube. When closed at the inner end parts of the flaps overlap as shown at 7. Then the high pressure to the left acts on a larger area than the low pressure to the right to maintain a good seal. If a flap can be distorted to break the seal it is possible by further action to open the tube to permit the container to be filled, or to discharge fluid from the container.

After filling, closing action can be initiated by the resilience of the flaps tending to bring them together again.

FIG. 16 shows that there is a wide range of position of the connection 8 about which the flaps can move as long as they are on one side of the perpendicular 9 to the sealing interface 10 at the sealing interface area.

The invention may be carried into practice in various ways and certain embodiments will be described by way of example, with reference to the accompanying drawings, of which:

Figure 1:
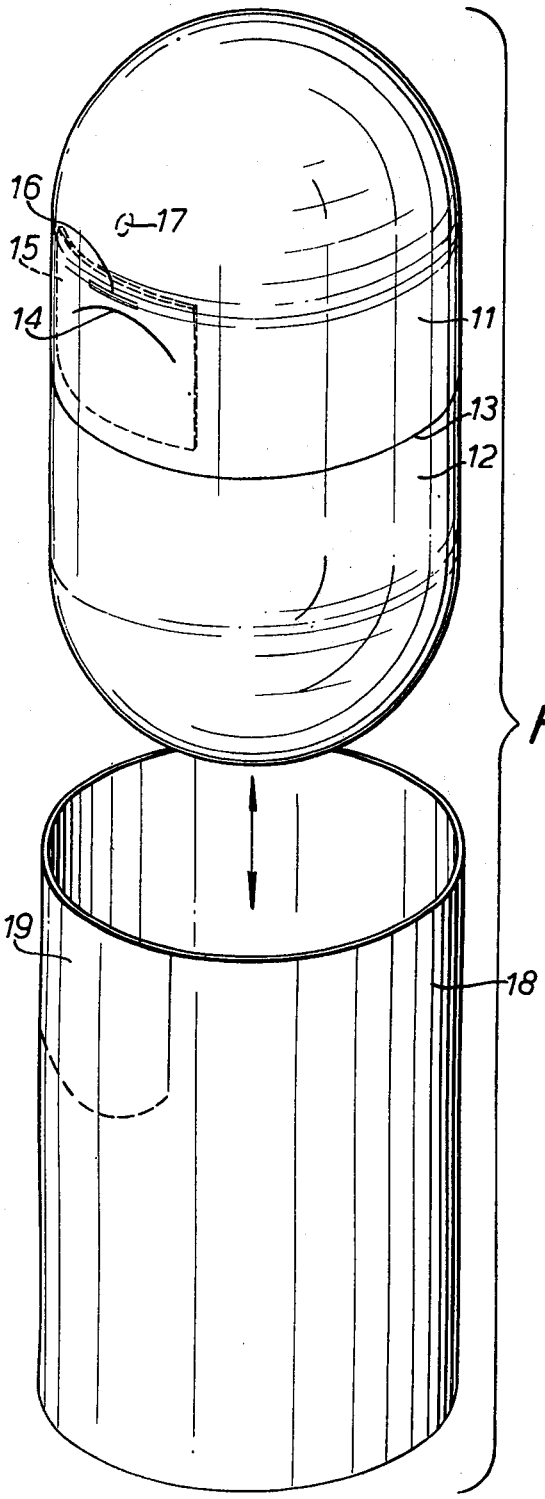
FIG. 1 shows the components of a beer container embodying the invention.

FIG. 1 shows a beer container sealed by a closure embodying the invention. A container consists essentially of two moulded halves 11 and 12 of clear stiff resilient plastics material which may be polyvinylchloride but is preferably acrylonitrile methyl acrylate or methacrylonitrile co-polymer which has a very low permeability to gas. The two halves 11 and 12 are generally cylindrical with hemispherical ends and they are spin-welded together at 13 to form a closed container.

Prior to welding the halves together the closure is formed in the upper half 11 by cutting an arcuate slot 14 in the wall of the half close to the top of the cylindrical portion and by securing to the inside of the half and covering the slot 14 a flap 15 which is also of a stiff resilient plastics material. The slot 14 is cut during forming by pressing the wall of the half radially inwardly against an arcuate knife and then the flap is positioned as shown and is located at 16 as by a spot-weld or possibly by an adhesive. During the location heat applied and pressure applied to the flap 15 can make it conform closely to the inner surface of the half 11.

Figure 3:
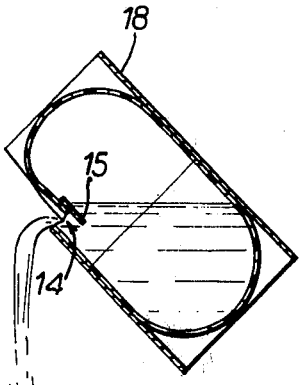
FIG. 3 is a view similar to FIG. 2 showing beer being poured from the container.

The container can be filled with carbonated beer by applying inward pressure locally at 17 which may in fact be a spot marked on the container so that a part of the wall of the half 11 above the slot 14 is distorted inwardly as indicated in FIG. 3 carrying with it the flap 15 and permitting fluid to enter through the opening defined by the edges of the slot 14.

Figure 2:
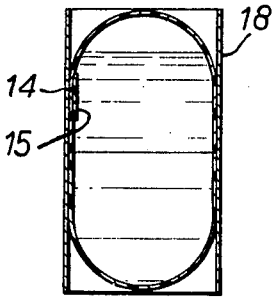
FIG. 2 is a section through the container of FIG. 1, in its condition for storage and transport.

After filling (preferably up to a level above that of the flap 15 as indicated in FIG. 2) and release of the pressure at 17 the natural resilience of the half 11 causes it to resume its initial shape and the natural resilience of the flap 15 causes it to move back over the inside of the arcuate slot 14 in which position it is held firmly closing the opening by the pressure differential due to pressurised carbonated fluid inside as against the ordinary atmospheric pressure outside.

A paper-board sleeve 18 is slid over the container leaving a short portion protruding beyond each hemispherical end so that the container can be stood upright. The hemispherical ends are an ideal shape for withstanding the internal pressure and the cardboard sleeve reinforces the cylindrical middle part of the container.

During transit and storage the opening is protected by the sleeve 18 but when the beer is to be drunk a perforated flap 19 is torn out of the sleeve 18 to give access to the spot 17 and the slot 14 so that with pressure on the spot 17 the beer can be poured out as shown in FIG. 3. It will be noted that manual pressure applied at 17 will be sufficient to move the flap 15 away from the back of the slot 14.

If all the beer is not used at one pouring, once pressure has been released from 17 the natural resilience restores the container to its original configuration and once again the pressure inside provides an effective seal against leakage.

The cardboard sleeve prevents pilfering and also can carry printed matter describing the contents of the container. It could in fact be closed at one end to define a cup into which the fluid can be poured.

Although the two halves 11 and 12 have been described as being partly cylindrical they could be slightly frusto-conical so that numbers of individual halves can be stacked together for transit or storage before the container is assembled, and then the sleeve would be correspondingly tapered.

The spin-welding, or possibly even ultra high frequency welding, of the two halves together may be through the means of co-operating internal or external flanges (not shown) on the two halves or even on beads formed at the co-operating edges of the two halves. It would also be possible to provide internal flange welding by purging the container of air using $CO_2$ and putting the container in an evacuated chamber for the welding operation, during which the internal pressure will hold the two surfaces in contact.

It is preferred that a fluid sealant is used between the flap 15 and the corresponding part of the half 11 but this may in fact be the beer or other liquid itself or possibly an oil or wax coating could be applied to the flap when it is put in position, provided the oil or wax is edible and does not affect the beer.

Figure 4:
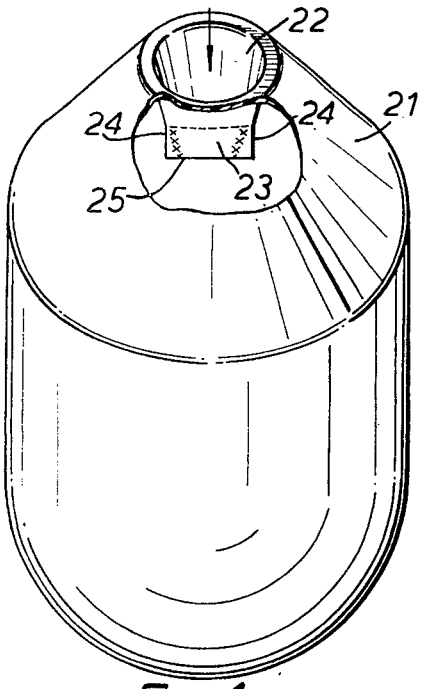
FIG. 4 is a perspective view of a similar container with an alternative form of closure.

FIG. 4 shows a different container in that one end 21 is frusto-conical and in this case there is an internal dimple 22 at the top of the cone, the sides of which lead into a closure consisting of two walls 23 united along their sides 24 but separate at the inner end 25. Normally the pressure differential between the interior and the chamber 22 will be sufficient to hold the two walls 23 firmly against one another to prevent leakage.

Figure 5:
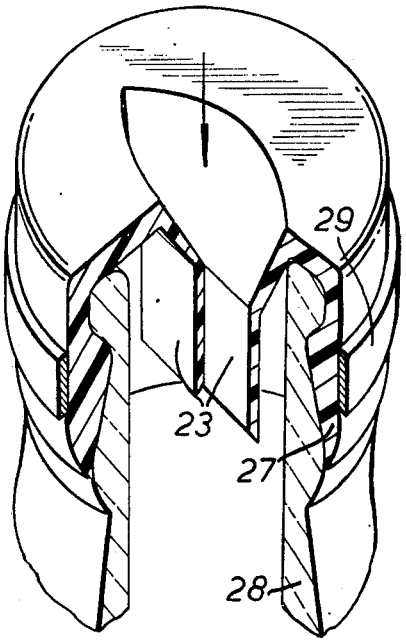
FIGS. 5, 6, 7, 8 and 9 are diagrams of alternative forms of closure.

FIG. 5 has a similar closure embodied in a cap 27 for a bottle 28. The cap 27 can be distorted to open the closure by separating the two walls which have again been given the numerals 23. A metal ring 29 is shown for holding the cap on the bottle.

Figure 6:
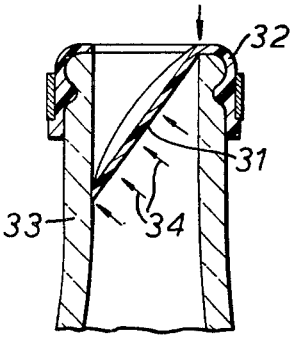

FIG. 6 shows a different kind of closure for a bottle in which the central part 31 of the resilient plastics closure member 32 can be pressed inwardly to open the closure. However its natural resilience tends to cause it to go back to the position shown in FIG. 6 in which it acts against the internal wall of the neck of the bottle 33 and this closing feature is assisted by the pressure differential due to the high pressure within the bottle as indicated generally at 34.

Figure 7:
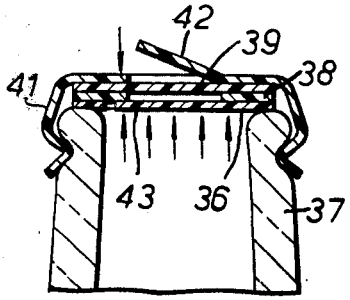

A somewhat similar closure is shown in FIG. 7 where the resilient plastics closure 36 is held on the top of the bottle 37 by an annular washer 38, a protective disc 39 and a metal cap 41. The cap 41 has a central flap 42 which can be pressed inwards to rupture the disc 39 and push a correspondingly shaped flap 43 forming part of the resilient plastics member 36 inwardly to open the bottle. Again, when pressure is released, the resilience of the material of the flap 43 tends to restore it to its position acting against the washer 38 to close the bottle and this force is assisted by the pressure differential.

Figure 8:
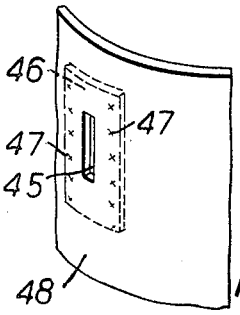

FIG. 8 shows a container with a slot opening 45 and against the inner side of the wall a flap of resilient plastics material 46 is spot-welded along its two vertical edges as indicated at 47. Normally the pressure differential holds the flap firmly against the inside of the slot 45, but when the wall 48 is distorted the flap 46 can move away from the wall 48 to allow passage of fluid.

Figure 9:
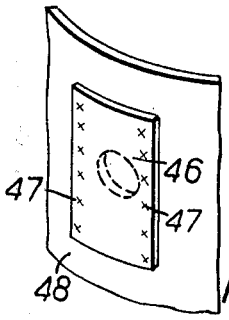

FIG. 9 is for a similar arrangement but in which the flap—also indicated as 46—is welded at its vertical edges 47 to the outside of the wall 48. This is for a type of container in which the pressure differential acts inwardly, the pressure inside being normally less than atmospheric pressure.

Figure 10:
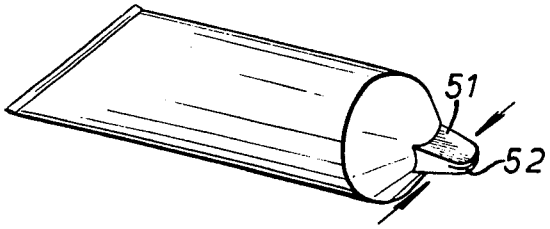
FIG. 10 shows how the closure can be applied to a tube for tooth-paste or glue.

An application of this type of closure is shown in FIG. 10 as a tube for glue which can be moulded in one piece to have an integral end as indicated at 51 which is very similar to the internal seal 24 of FIG. 4 except that the opposed flat walls extend outwardly instead of inwardly as shown in that Figure. Pressure in the directions indicated by the arrows causes the resilient material to distort to open the mouth at the slot 52 in the end of the nozzle. Material can then be squeezed from the tube, but when squeezing ceases, the walls 51 resile and move back together re-sealing the opening and preventing air entering the tube. Then the internal pressure is no more than atmospheric pressure and probably less, so that the effect of the differential internal and external pressures and areas together with the resilience of the material maintains a tight seal without having a cap or a pin.

The wall around the opening in any of the embodiments could incorporate, or be influenced by, a spring to assist the natural tendency of the opening to close itself.

The nature of the operation of the various seals can be appreciated from FIGS. 11 to 15.

Figure 11:
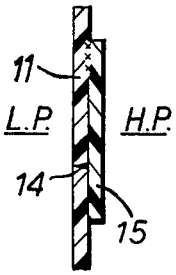
FIGS. 11 to 15 are diagrams for illustrating the principles of operation of the various closures.

FIG. 11 corresponds to FIG. 1 and shows how the arcuate slot opening 14 is normally closed by the flap 15 due to the high internal pressure acting on the whole of the internal area of the flap. The slot can only be opened by pressing the wall 11 adjacent the opening to force the flap away, and as soon as the pressure is removed, the resilience of the flap and the wall start a re-closing movement which is assisted by the internal pressure.

Figure 12:
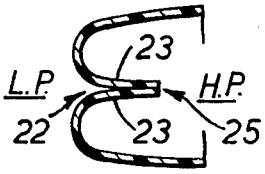

FIGS. 4 and 5 operate as shown in FIG. 12. The high internal pressure acts on a greater area of the walls 23 than the lower external pressure and assists the resilience of the walls in holding the opening 25 closed. Opening can only be by distorting the material to move one wall away from the other.

Figure 13:
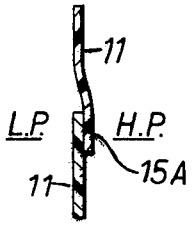

FIG. 13 shows how the flap 15 could effectively be constituted by an extension 15A of the wall 11. The action is the same as with FIG. 11.

Figure 14:
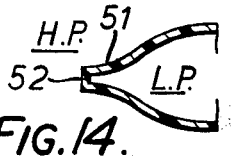
Figure 15:
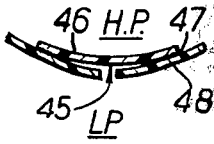
Figure 16:
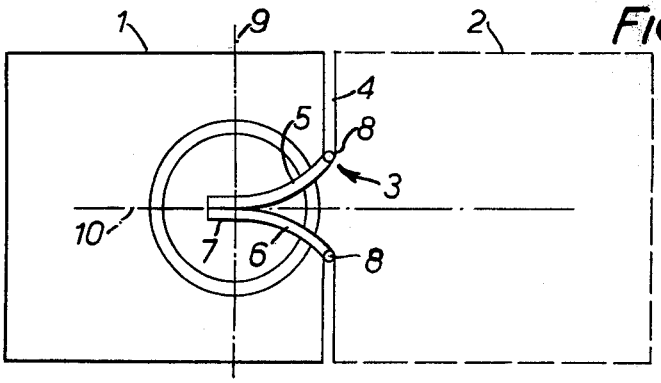

FIG. 14 shows how the arrangement of FIG. 10 is rather similar to that of FIGS. 4 and 12 with the necessary modification of shape due the internal pressure being the lower pressure. Again the walls 51 have to be distorted to open the slot opening 52. Finally FIG. 15 corresponds to FIG. 8 and shows the slot 45 open due to distortion of the wall 48. Once the external distorting pressure is removed, resilience and pressure automatically re-seal the opening.

Figure 22:
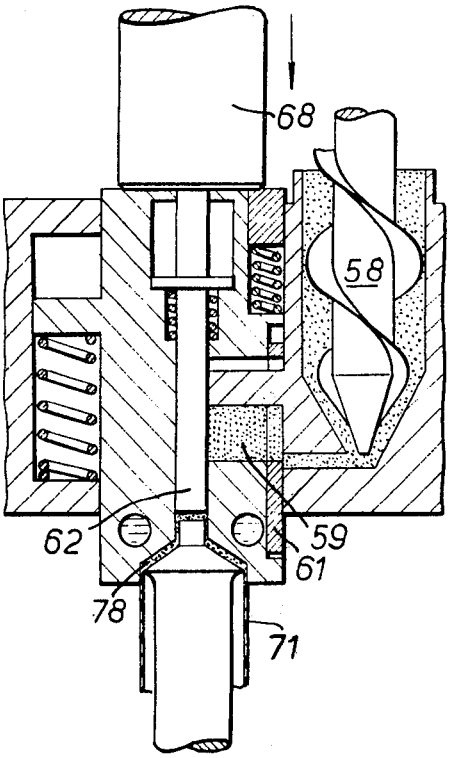
Figure 23:
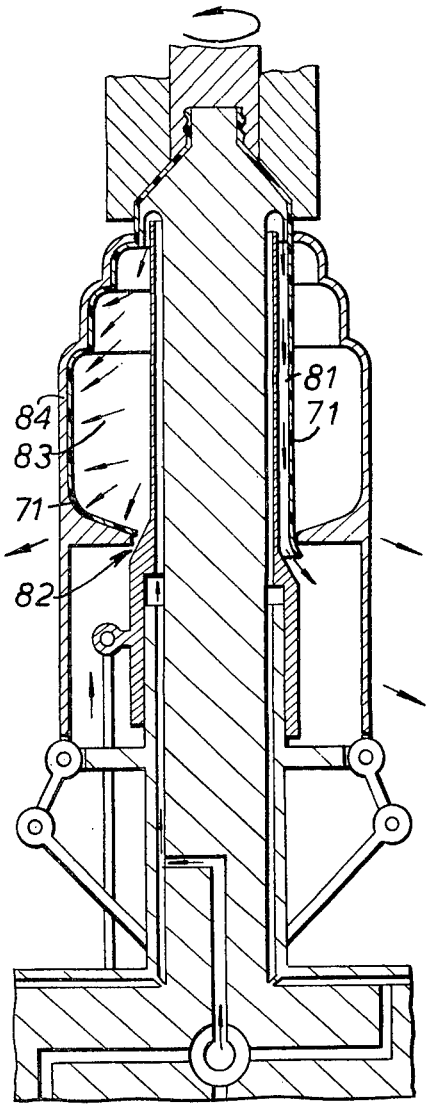
Figure 24:
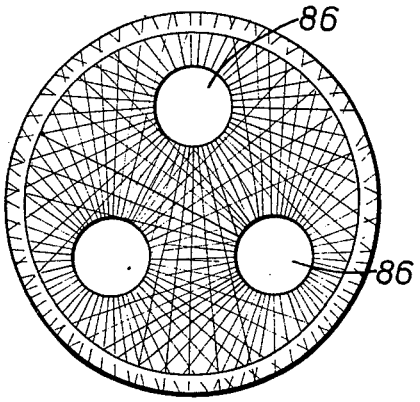
Figure 25:
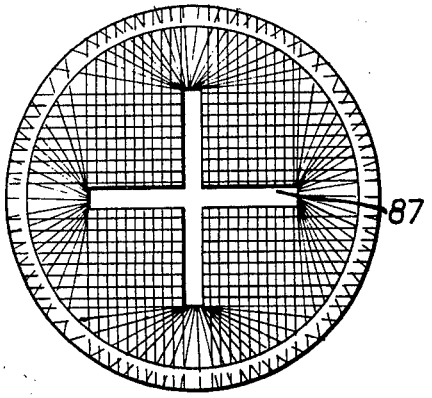
Figure 26:
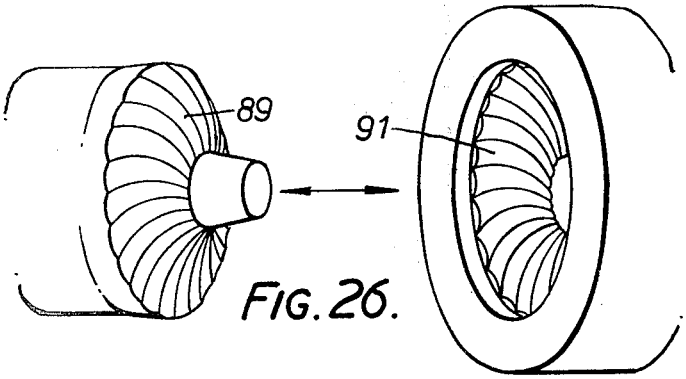

The containers may be made in various ways but a preferred method according to an aspect of the invention is shown in FIGS. 17–22 of the drawings which illustrate successive stages in the production of hollow containers;

FIG. 23 is a diagram showing how a tube formed by the method described with reference to FIGS. 17 to 22 can be subsequently moulded to a convoluted shape by compressed air;

FIGS. 24 and 25 are two enlarged end views of the female mould of FIGS. 17 to 23 showing different arrangements of openings for introduction of the slug of plastics material for forming into the tube; and FIG. 26 is a diagram showing how the male and female moulds can be profiled to give better distribution of fibres in the final material.

Moulding by the method shown with reference to FIGS. 17 to 22 is performed by discharging a slug of plastics material into a female mould 51 defined in the lower end of a block 52 which can slide vertically in a housing 53 between an upper stop 54 and a lower stop 55, there being a compression spring 56 tending to urge the member 52 against its upper stop. The male mould 57 co-operates with and is closely spaced from the corresponding part of the female mould. These are an array of male moulds 57 which move into position in turn, an empty mould arriving, and then leaving carrying a formed container for a subsequent operation.

The charge of material is fed by a screw extruder 58 into a metering chamber 59 which can be closed off by a gate 61 when full, and the charge in the chamber is eventually pushed into an end of the female mould by means of a piston 62 which can slide within the block 52 between stops 63 and 64 under the action of a compression spring 65. The gate 61 is operated by an integral boss 66 also slidable in the block 52 against a compression spring 67.

Figure 17:
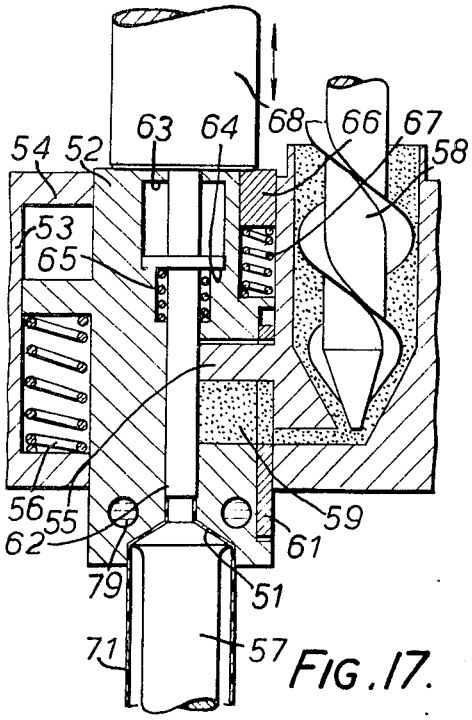
FIGS. 17 to 26 illustrate various stages of the process for producing the containers of the present invention.

FIG. 17 shows the situation in which a reciprocating press tool 68 has just reached its lowest position so that the block 52, the piston 62 and the gate boss 66 are in their lowest positions and a tube like container 71 has just been formed. The neck of the container has its shape defined by the co-operating parts of the male and female moulds 51 and 57, and dependent from the neck is a continuous cylindrical tube whose section is that of the lower end of the frusto-conical part of the male mould defining the neck of the container. This shape is achieved by having the lower end of the female mould open, and is suitable for making a container such as a toothpaste tube in which the lower end of the tube can be folded over after filling. However, for making an open-ended half bottle for welding to a similar half, the female mould would be extended downwards in sealing engagement around the male mould as indicated by 72 of FIG. 17A so that the complete shape of the moulded article would be defined within the moulds by the surfaces of one or both of them.

Figure 18:
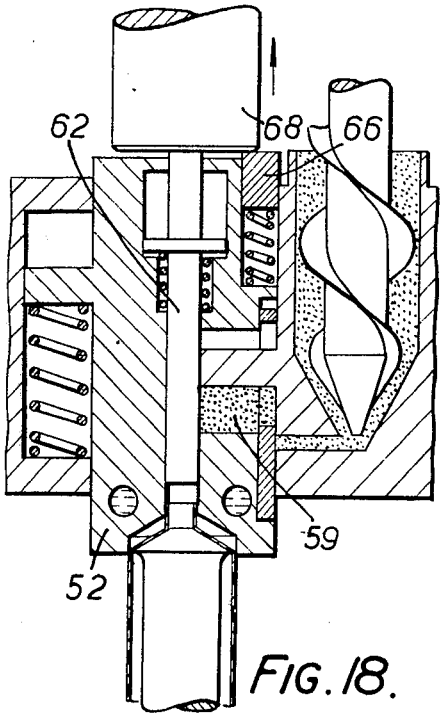

Referring now to FIG. 18 it will be seen that the press tool 68 has started to move upwards accompanied by the piston 62 and the gate boss 66 under the action of their springs. The block 52 cannot yet move upwards because of the charge of material in the chamber 59.

Figure 19:
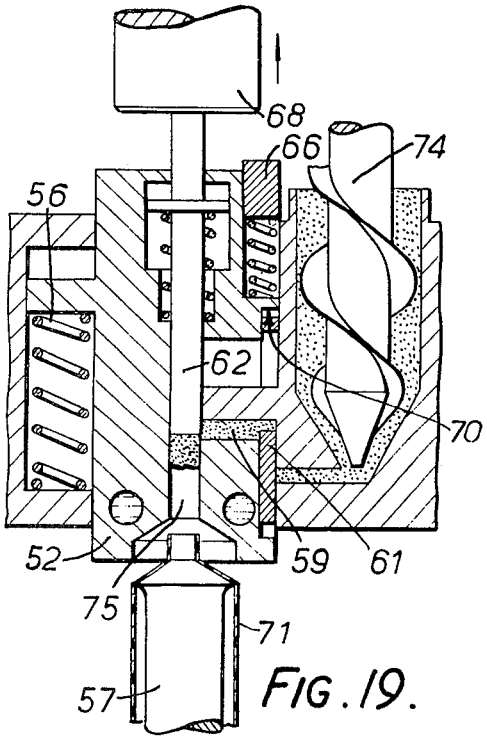

FIG. 19 shows that the tool 68 has moved further upwards and left the gate boss 66 as the latter has made contact with a stop 74 formed on the block 52. The piston 62 has continued to move with the press tool 68 and has moved past the metering chamber 59 so that the material can flow into the bore 75 below the piston. This movement is induced by upward movement of the block 52 due to its spring 56 and FIG. 19 shows the material entering the bore 75. The gate 61 has now cut off the supply of moulding material from the screw extruder 58. Also the block 52 is moving clear of the moulded container 71 on the male mould 57.

Figure 20:
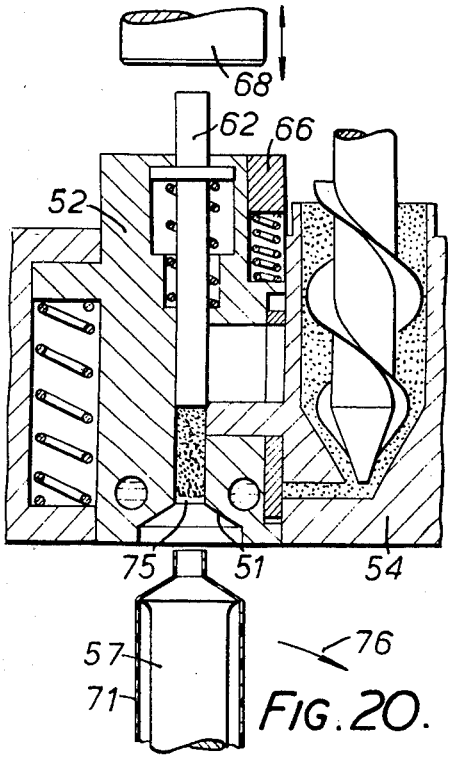

FIG. 20 shows the press tool 68 at the top of its stroke, having left the piston 62 against its stop so that the piston 62, the gate boss 66, and the block 52, are all in their uppermost positions in the body 54, and the female mould 51 has cleared the moulded article 71 which is now removed by turning the mould 57 in the direction shown by the arrow 76 so that the container can be further processed. Also all the moulding material for the next container has been driven from the metering chamber into the bore 75.

Figure 21:
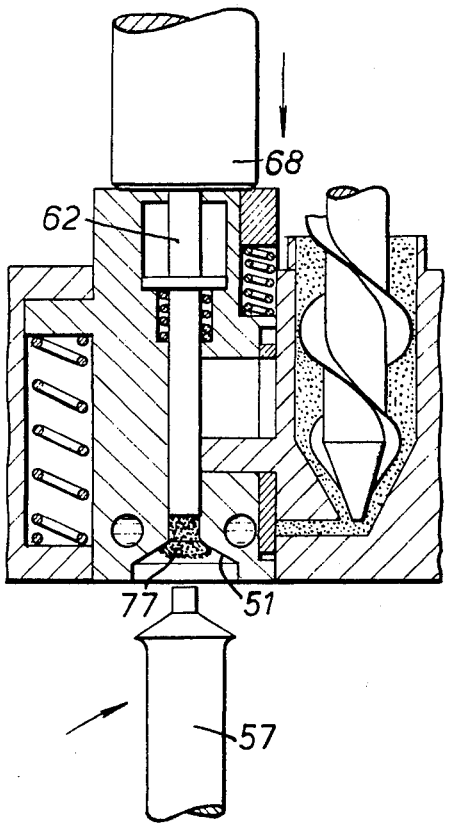

The press tool 68 now starts to move down again as shown in FIG. 21, first moving the piston 62 to feed the slug 77 of material into the end of the female mould 51 in which condition it fills the opening. A different male mould 57 has now been moved into position ready for the next moulding.

As the press tool 68 moves further downwards as shown in FIG. 22 the piston gate boss, and block, all move downwards so that the mould cavity indicated generally at 78 is reduced towards its final shape with the consequence that the moulding material is compressed and forced to flow around the male mould and is eventually extruded as a formed continuous cylinder 71.

The compression and/or the friction as the material slides over the mould surfaces provides additional heating of the mould material to enable it to flow properly to be formed into a good article. It will be seen that in this position the lower end of the piston 62 forms the end of the female mould defining the top end of the container. It will also be seen from FIG. 22 that the metering chamber 59 has again become open to the extruder 58 with the lowering of the gate 61 so that the charge of material for the next container is in the metering chamber.

Finally when the press tool 68 bottoms, the situation of FIG. 17 is again arrived at with the mould cavity fully reduced and the article 71 fully formed. At this stage cooling to freeze the article can be achieved by passing a liquid coolant through passages 79 formed in the block 52.

It is also possible to cool the cylindrical extrusion 71 by passing cooling liquid or coolant gas over its surfaces in the manner indicated at the right-hand side of FIG. 23 where the cylinder 71 can be seen around a channel 81 for cooling gas. Before this cooling it is possible to form the cylinder still further. Thus as shown in the left-hand side of FIG. 23, once a seal is made at 82, air pressure as indicated at 83 can be used to blow the cylinder 71 into contact with a female mould surface 84 where it will finally cool in contact with the cold mould surface. The top of the article will of course have been formed between the male and female moulds.

In some cases it is possible to get a stronger walled article by getting the material to flow in different directions as the mould cavity is reduced to produce a kind of lattice work of the fibres of the plastic. One way of doing this is to introduce the moulding material through a number of apertures 86 distributed around the end face of the female mould so that as material is forced outwards from each aperture, a cross lattice effect is achieved. An alternative arrangement is shown in FIG. 25 in which there is a single aperture 87 but it is of cruciform shape so that the material spreads in different directions as indicated.

It is possible to achieve a similar effect in a different way by forming the co-operating male and female mould surfaces 89 and 91 with arcuate convolutions as shown in FIG. 26, so that as the moulds finally move together in the step between FIGS. 22 and 17, the material is given a component of movement around the axis of the moulds. The two curves could be of the same or opposite hand. It is also possible to turn one or other of the moulds about its axis during this movement.

The apertures 86 or 87 can act as centres of resistance possibly to keep the male mould centred or even displace a little in a selected direction, for example if a slightly thicker wall is needed for local attachment of a handle.

Figure 17A:
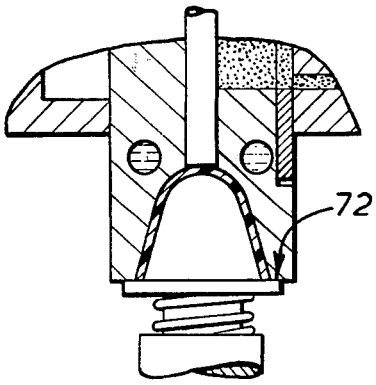

If the article being moved, such as a half of the bottle indicated in FIG. 1 but shaped with tapered sides as at 72 in FIG. 17A for nesting, then the correspondingly tapered mould surfaces to produce them will be reducingly spaced apart as the male and female moulds close the cavity.

The bottle indicated in FIG. 1 has hemispherical ends because if stress in the unsupported ends are to be tensile rather than bending and thereby resist internal pressure economically, then they must be radial about a centre of pressure which may be varied along an axis between the centre of the pressurized volume and a point radially central at the end of the portion which is supported by a surrounding cylindrical or frusto-conical paperboard reinforcement sleeve or sleeves.

Accordingly an aspect of the invention consists of a method of moulding a container in which a charge of moulding material is fed through an aperture in the mould into a position closing the aperture, components of the mould are then moved to reduce the mould cavity and cause the material to spread throughout the cavity, the material being heated due to compression and/or friction as it moves over the mould surfaces. The invention also includes a machine for such a method.

What I claim as my invention and desire to secure by Letters Patent is:

1. A closure for a sealed fluid container comprising:
an elastically resilient container wall;
an opening in said container wall;
an elastically resilient flap member having a sealing surface and resiliency for acting to cause said surface to normally lie in intimate overlapping sealing contact with said container wall so as to close said opening; and
a portion of said container wall immediately around said opening being capable of distortion to cause said sealing surface of said flap member to move away from said container wall to allow fluid to pass through said opening.

2. A closure as claimed in claim 1 including a fluid sealant between the surface of the flap member and the wall.

3. A closure as claimed in claim 1 in which the resilient flap member is part of the container wall.

4. A closure as claimed in claim 1 including two separable walls lying one against the other, one of which constitutes the resilient flap member.

5. A closure as claimed in claim 1 in combination with an enclosure of resilient plastics material for a drink, the closure closing an opening in the wall of the enclosure.

6. In combination, a container for a drink consisting of two separately formed parts joined together, one of them having an opening, and a closure as claimed in claim 1 closing and sealing the opening.

7. A container comprising a closure as claimed in claim 1 and a sleeve for giving support to the walls of the container.

8. A container as claimed in claim 7 in which the sleeve covers the opening.

9. A closure as claimed in claim 1 in which the surface of the flap member and the portion of the wall with which the latter cooperates are shaped for complemental engagement with one another.

10. A closure for a sealed container of pressurized liquid comprising:
an elastically resilient container wall;
an opening in said container wall;
an elastically resilient flap forming a sealed interface with said wall and controlling flow from the container through said opening, a pressure differential between the internal substantially superatmospheric pressure and the absence of pressure between the sealed interface acting to prevent the flow and distortion of a part of said wall of the container adjacent the opening to move said flap permitting the flow; and
a relatively non-resilient cover surrounding said wall for preventing deformation of the latter due to internal pressure in the container, but providing access to the said part of said wall.

* * * * *

UNITED STATES PATENT OFFICE

CERTIFICATE OF CORRECTION

PATENT NO. : 3,935,975

DATED : February 3, 1976

INVENTOR(S) : John Harry Gauntlett

It is certified that error appears in the above-identified patent and that said Letters Patent are hereby corrected as shown below:

[30] Foreign Application Priority Data

[Jan. 9, 1970] Jan. 19, 1970 United Kingdom.....2403/70

Signed and Sealed this

Twenty-eighth Day of September 1976

[SEAL]

*Attest:*

RUTH C. MASON
*Attesting Officer*

C. MARSHALL DANN
*Commissioner of Patents and Trademarks*